US009484045B2

(12) United States Patent
Sorin et al.

(10) Patent No.: US 9,484,045 B2
(45) Date of Patent: Nov. 1, 2016

(54) SYSTEM AND METHOD FOR AUTOMATIC PREDICTION OF SPEECH SUITABILITY FOR STATISTICAL MODELING

(75) Inventors: Alexander Sorin, Haifa (IL); Slava Shechtman, Haifa (IL); Vincent Pollet, Astene (BE)

(73) Assignee: Nuance Communications, Inc., Burlington, MA (US)

( * ) Notice: Subject to any disclaimer, the term of this patent is extended or adjusted under 35 U.S.C. 154(b) by 582 days.

(21) Appl. No.: 13/606,618

(22) Filed: Sep. 7, 2012

(65) Prior Publication Data

US 2014/0074468 A1 Mar. 13, 2014

(51) Int. Cl.

| | |
|---|---|
| ***G10L 13/06*** | (2013.01) |
| ***G10L 13/04*** | (2013.01) |
| ***G10L 19/00*** | (2013.01) |
| ***G10L 25/48*** | (2013.01) |
| ***G10L 25/18*** | (2013.01) |

(52) U.S. Cl.

CPC ..... *G10L 25/48* (2013.01); *G10L 25/18* (2013.01); *G10L 13/04* (2013.01)

(58) Field of Classification Search

CPC ..... G10L 25/18; G10L 13/04; G10L 25/48; G10L 13/06; G10L 19/00

USPC ..... 704/236, 260

See application file for complete search history.

(56) References Cited

U.S. PATENT DOCUMENTS

| | | | | |
|---|---|---|---|---|
| 6,324,501 | B1 * | 11/2001 | Stylianou | G10L 21/04 704/201 |
| 6,535,843 | B1 | 3/2003 | Stylianou et al. | |
| 6,577,996 | B1 * | 6/2003 | Jagadeesan | G10L 25/69 704/236 |
| 7,254,532 | B2 * | 8/2007 | Fischer | G10L 25/78 704/200 |
| 8,655,656 | B2 * | 2/2014 | Ketabdar | G10L 25/48 704/226 |
| 2003/0078770 | A1 * | 4/2003 | Fischer | G10L 25/78 704/214 |
| 2009/0048841 | A1 * | 2/2009 | Pollet | G10L 13/07 704/260 |
| 2011/0000360 | A1 * | 1/2011 | Saino | G10H 1/0008 84/622 |

OTHER PUBLICATIONS

Hermansky, H. "Perceptual linear predictive (PLP) analysis of speech", J. Acoust. Society of America, Apr. 1990, pp. 1738-1752.*

(Continued)

*Primary Examiner* — Pierre-Louis Desir
*Assistant Examiner* — Seong Ah A Shin
(74) *Attorney, Agent, or Firm* — Hamilton, Brook, Smith & Reynolds, P.C.

(57) ABSTRACT

An embodiment according to the invention provides a capability of automatically predicting how favorable a given speech signal is for statistical modeling, which is advantageous in a variety of different contexts. In Multi-Form Segment (MFS) synthesis, for example, an embodiment according to the invention uses prediction capability to provide an automatic acoustic driven template versus model decision maker with an output quality that is high, stable and depends gradually on the system footprint. In speaker selection for a statistical Text-to-Speech synthesis (TTS) system build, as another example context, an embodiment according to the invention enables a fast selection of the most appropriate speaker among several available ones for the full voice dataset recording and preparation, based on a small amount of recorded speech material.

17 Claims, 10 Drawing Sheets

(56) References Cited

OTHER PUBLICATIONS

Tiomkin, S., "A Hybrid Text-to-Speech System that Combines Concatenative and Statistical Synthesis Units" IEEE Transactions on Audio, Speech and Language Processing, 19(5), Jul. 2011, pp. 1278-1288.*

Sorin, A., et al. "Uniform Speech Parameterization for Multi-form Segment Synthesis" in Proc. Interspeech 2011, Aug. 2011, pp. 337-340.*

Sorin, A., et al. "Psychoacoustic Segment Scoring for Multi-Form Speech Synthesis" in Thirteenth Annual Conference of the International Speech Communication Association, 2012.*

Pollet, V., et al., "Synthesis by Generation and Concatenation of Multiform Segments", in Proc. *Interspeech* 2008, Sep. 22-26, 2008, pp. 1825-1828.

Sorin, A., et al. "Uniform Speech Parameterization for Multi-form Segment Synthesis" in Proc. *Interspeech* 2011, Aug. 28-31, 2011, pp. 337-340.

Hermansky, H. "Perceptual linear predictive (PLP) analysis of speech", J. Acoust. Soc. Am. 87(4), Apr. 1990.

Aylett, M. "Combining Statistical Parameteric Speech Synthesis and Unit-Selection for Automatic Voice Cloning" In *Proc. LangTech 2008*, Sep. 2008.

Tiomkin, S., "A Hybrid Text-to-Speech System that Combines Concatenative and Statistical Synthesis Units" IEEE Transactions on Audio, Speech and Language Processing, 19(5), Jul. 2011.

* cited by examiner

SYSTEM AND METHOD FOR AUTOMATIC PREDICTION OF SPEECH SUITABILITY FOR STATISTICAL MODELING

BACKGROUND OF THE INVENTION

A hybrid approach being explored recently in Text-to-Speech Synthesis (TTS) includes concatenating natural speech segments and artificial segments generated from a statistical model. Herein, this approach is referred to as Multi-Form Segment (MFS) synthesis, the natural segments are referred to as template segments or templates, and the artificial segments generated from statistical models are referred to as model segments. A voice dataset of an MFS TTS system contains a templates database and a set of statistical models typically represented by states of Hidden Markov Models (HMM). Each statistical model corresponds to a distinct context-dependent phonetic element. A many-to-one mapping exists that establishes an association between the templates and the statistical models. In synthesis time, input text is converted to a sequence of the context-dependent phonetic elements. Then, each element can be represented by either a template or a model segment generated from the corresponding statistical model.

The motivation behind the MFS approach is to combine the advantages of unit selection or the concatenative TTS paradigm, which operates purely on template segments, and the statistical TTS paradigm to build a flexible system that produces natural sounding speech with stable quality for a wide range of system footprints. However, if the voice character differs significantly between the concatenated template and model segments, the switching between the template and model segments deteriorates human perception. The perceptual quality of the MFS synthesis output strongly depends on the representation type (template versus model) selected for each segment comprising the synthesized sentence. If the representation type decision is made off-line prior to synthesis for all of the segments available within the voice dataset then the templates database can be pruned, resulting in system footprint reduction as model segments can be stored more compactly compared to template segments.

In another context, there is the problem of how to select a speaker for building a statistical TTS system. Voice dataset preparation for a statistical TTS model training is an intensive human labor and time consuming process. It typically includes the recording of several hours (e.g., 5-10 hours) of speech in a studio environment that is done in several sessions, and several person-weeks are required afterwards for manual error correction in speech transcripts and in phonetic alignment. Characteristics of the recorded voice significantly influence the final quality of the generated speech. The models produced from one speaker perform better than those built from another, while the gender, recording conditions, and the build process are very similar.

SUMMARY OF THE INVENTION

An embodiment according to the invention provides a capability of automatically predicting how favorable a given speech signal is for statistical modeling, which is advantageous in a variety of different contexts. In Multi-Form Segment (MFS) synthesis, for example, an embodiment according to the invention uses this capability to provide an automatic acoustic driven template versus model decision maker with an output quality that is high, stable, and depends gradually on the system footprint. In speaker selection for a statistical Text-to-Speech synthesis (TTS) system build, as another example context, an embodiment according to the invention enables a fast selection of the most appropriate speaker among several available ones for the full voice dataset recording and preparation, based on a small amount of recorded speech material. An embodiment according to the invention may be used in other contexts in which it is advantageous to determine suitability of a speech signal for statistical modeling automatically.

In accordance with an embodiment of the invention, there is provided a system (or corresponding method) for automatically determining suitability of at least a portion of a speech signal for statistical modeling. The system comprises a modelability estimator configured to determine a statistical modelability score of the at least a portion of the speech signal, the determining of the statistical modelability score being based at least in part on determining a temporal stationarity of the at least a portion of the speech signal; and a decision maker configured to determine suitability of the at least a portion of the speech signal for statistical modeling based at least in part on the statistical modelability score. As used herein, a "temporal stationarity" of a signal is a measure of the extent to which an instantaneous characteristic of the signal varies with respect to time.

In further, related embodiments, the modelability estimator may be further configured to determine the temporal stationarity based on variability of an instantaneous spectrum of the at least portion of the speech signal. The modelability estimator may be still further configured to determine the variability of the instantaneous spectrum based on (i) a first moment of an instantaneous spectrum component distribution and (ii) a second moment of the instantaneous spectrum component distribution.

In further, related embodiments, the decision maker may be further configured to determine a segment representation type in a multi-form segment speech synthesis based on the statistical modelability score. The modelability estimator may be further configured to determine the statistical modelability score for at least one segment comprising at least a portion of an output speech signal being synthesized, and the decision maker may be further configured to determine the segment representation type, for the at least one segment, based on at least the statistical modelability score for the at least one segment. The modelability estimator may be further configured to determine, for at least one segment comprising at least a portion of an output speech signal being synthesized, the statistical modelability score for a segment cluster that includes the at least one segment, and the decision maker may be further configured to determine the segment representation type, for the at least one segment, based on at least the statistical modelability score of the segment cluster that includes the at least one segment. The system may further comprise a templates pruner configured to remove from a voice dataset at least one segment relative to its statistical modelability score. The statistical modelability score may be further based at least in part on a loudness score.

In another related embodiment, the decision maker may be further configured to determine a preferred speaker selection for building a statistical text-to-speech system based on the statistical modelability score determined for speech provided by each of a plurality of speakers.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

Figure 1:
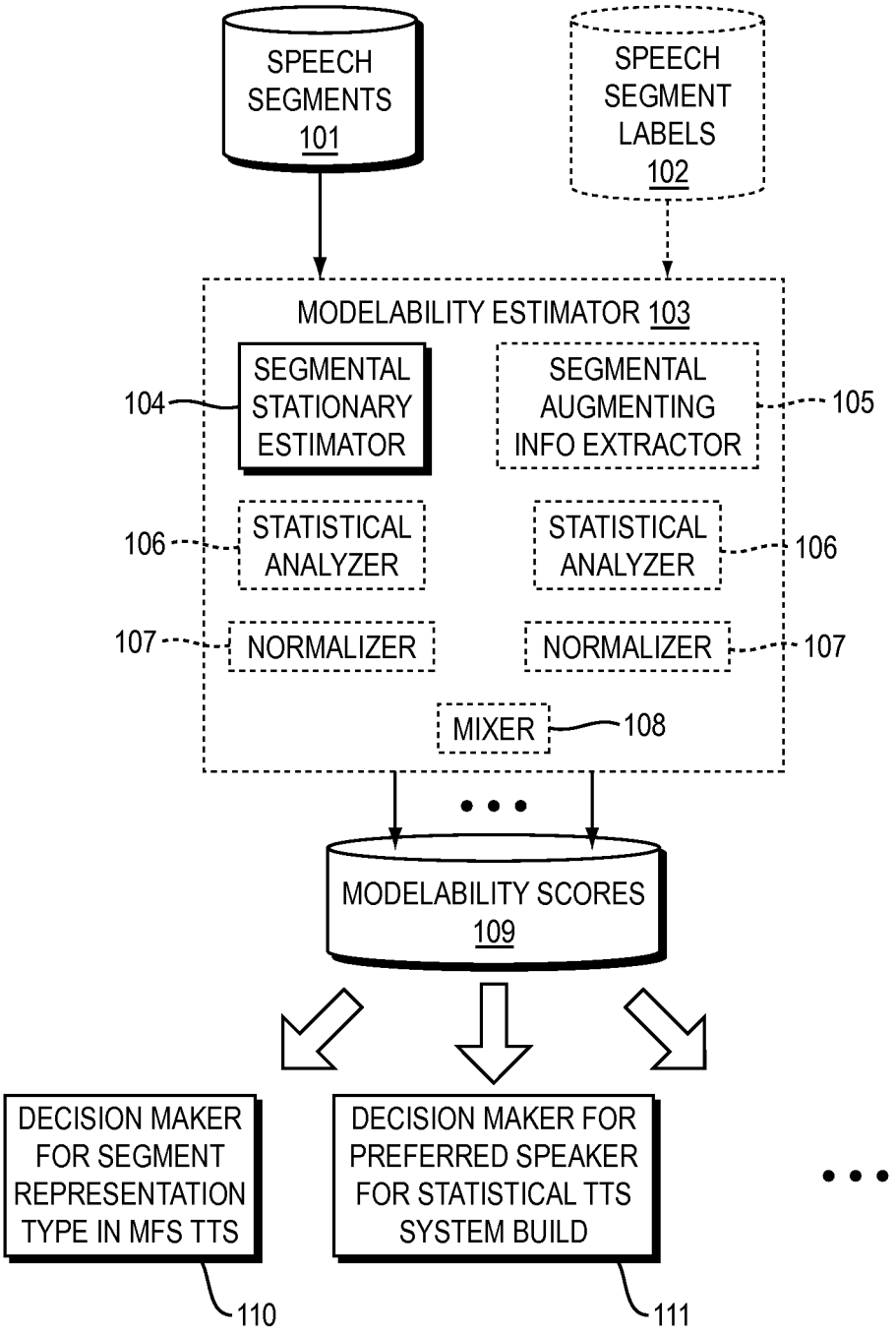
FIG. 1 is a block diagram of a system for automatically determining suitability of at least a portion of a speech signal for statistical modeling, in accordance with an embodiment of the invention.

A description of example embodiments of the invention follows.

Open questions in Multi-Form Segment (MFS) synthesis are whether devising an automatic acoustic driven template versus model decision maker is possible so that the output quality is highly natural, homogeneous and depends gradually on the system footprint, and, if possible, how to devise such a decision maker.

In another context, i.e., the context of selecting a speaker for building a statistical TTS system, it would be useful to have a method for the final statistical TTS quality prediction based on a small amount of recorded speech material provided by a candidate speaker. Such a method would enable a fast selection of the most appropriate speaker among several available ones for the full voice dataset recording and preparation.

At first glance, the two above mentioned problems seem different from each other. However, the solutions to both problems require the same capability: an automatic acoustic properties based prediction of how favorable a given speech signal is for statistical modeling in terms of human perception.

Embodiments according to the present invention provide:

1) A method of estimating statistical modelability of a given speech segment. As used herein, a "statistical modelability" or simply "modelability" is favorability of a given speech segment for statistical modeling, or, in other words, how accurately the speech segment can be represented by a statistical model trained on similar segments from a human perception viewpoint. The method is based on temporal stationarity estimation of the speech segment. As used herein, a "temporal stationarity" of a signal is a measure of the extent to which an instantaneous characteristic of the signal varies with respect to time.

2) A method of determining a temporal stationarity score for a given speech segment using an instantaneous spectrum in the form of a Short-Time Fourier Transform transformed to a perceptual scale as the instantaneous characteristic above. For example, the instantaneous characteristic may be the first and second moments of the segment. The score is indicative of the segment modelability.

3) A method for speech segment representation type selection in multi-form speech synthesis. As used herein, a "segment" is a contiguous portion of a speech signal representing a basic context-dependent phonetic element, e.g., one third of a phoneme, which may for example be used by a target MFS system.

In one embodiment, a statistical modelability score combining the stationarity and loudness is computed and stored for each template segment available in the templates database. The scores can be used in synthesis time for dynamic selection of the representation type (model versus template).

In another embodiment, aiming at system footprint reduction, the method operates on a cluster of segments derived from a plurality of speech signals rather than on an individual segment. A cluster is associated with a distinct statistical model of the MFS system. Typically the model is given in the form of a Hidden Markov Model (HMM) state. The clustering procedure is commonly implemented using a contextual decision tree built for spectral parameters stream. The clusters are associated with the leaves of the tree and are referred to herein as "acoustic leaves" or simply "leaves." Depending on the target footprint, each leaf is classified as template or model based on a statistical modelability score combining the stationarity and loudness statistics of the comprising segments. The template versus model classification above may be based on the statistical modelability score combined with phonological information. The natural segments associated with those leaves classified as model are removed from the voice dataset which leads to the footprint reduction of the final MFS system. The template versus model representation selection is taken depending whether the leaf contains templates or not.

4) A method for a preferred speaker selection for a statistical TTS system building. The selection process employs a small number of sentences (e.g., less than 100) from each candidate speaker. The speech data is segmented through an HMM-state level alignment process using an existing statistical acoustic model. The segmental stationarity statistics are compared between the candidate speakers. The speaker with the most stationary speech is selected.

FIG. 1 is a block diagram of a system for automatically determining suitability of at least a portion of a speech signal for statistical modeling, in accordance with an embodiment of the invention. The input to the system is a collection 101 of one or more speech segments provided by one or more speakers. Depending on an embodiment as described below, an additional input may be available in the form of symbolic labels 102 associated with the segments. The labels are defined depending on the context in which the system is used as described below. The input is fed to a modelability estimator 103. A modelability estimator 103 may be configured to output a modelability score for each segment.

Alternatively or additionally, if the segment labels 102 are fed in, the modelability estimator 103 may be configured to cluster the segments according to the labels and output a modelability score for each cluster. The modelability estimator 103 comprises a segmental stationarity estimator 104 used to estimate temporal stationarity of a segment. A modelability estimator 103 may additionally comprise all or some of the following processing blocks: 1) a segmental augmenting information extractor 105 used for extracting other information scores from a speech segment; 2) a statistical analyzer 106 used to gather segmental scores into clusters according to the labels and calculate statistics such as percentile of segmental scores within the clusters; 3) a normalizer 107 used for normalizing stationarity scores and augmenting information measures for example by mapping them to the interval [0,1]; 4) a mixer 108 used for combining stationarity information with augmenting information. A collection 109 of modelability scores output by modelability estimator 103 may be used in a variety of contexts in which it is advantageous to determine automatically the suitability of a speech signal for statistical modeling.

For example, the modelability scores may be input to a segment representation type decision maker 110 for Multi-Form Speech (MFS) synthesis. In this case, the collection of segments 101 is the templates database. Such segments are typically provided by a single speaker. Depending on an embodiment as described below, the labels 102 may be provided in the form of acoustic leaf identifiers available in the MFS voice dataset. The modelability estimator 103, in accordance with one embodiment, comprises the following blocks: 1) a segmental stationarity estimator 104: 2) a segmental augmenting info extractor 105 configured to estimate loudness of a speech segment; 3) a normalizer 107 configured to map stationarity and loudness scores to interval [0,1]; 4) a mixer 108 configured, for example, to calculate a linear combination of stationarity and loudness scores. Depending on the embodiment, as described below, if the labels 102 are provided the modelability estimator 103 may further comprise a statistical analyzer 106 configured to calculate a percentile of segmental stationarity information and segmental augmenting information within clusters.

In another example, the modelability scores may be input to a preferred speaker decision maker for statistical TTS 111. In this case, the input segments 101 are derived from speech signals provided by two or more candidate speakers and associated textual transcripts. The segments are preferably derived in the way it would be done during a TTS voice building. One of the known in the art techniques can be employed to segment the transcribed speech signals into segments using a grapheme-to-phoneme converter and pre-existing statistical acoustic models. The segments are labeled by respective candidate speaker identity. The modelability estimator 103, in accordance with one embodiment, comprises a segmental stationarity estimator 104 only.

Segmental Temporal Stationarity Score

In accordance with an embodiment of the invention, a segmental temporal stationarity score may be used as at least a part of the basis for an objective measure of the statistical modelability of a speech signal.

In accordance with an embodiment of the invention, an analyzed speech segment is divided into overlapping frames at a high frame rate, e.g., 1000 Hz. The frame length is chosen to be as small as possible providing that the frame includes at least one pitch cycle when the segment contains a portion of voiced speech. The frame size may be kept constant or be made variable adaptively to the pitch information associated with the analyzed segment. Typically the segment contains tens of frames. Each frame is converted to a Perceptual Loudness Spectrum (PLS) known in the art. A similar conversion is utilized in the popular Perceptual Linear-Predictive Acoustic Speech Recognition (ASR) analysis front-end described for example in Hermansky, H., "Perceptual linear-predictive analysis of speech", The Journal of Acoustical Society of America, 1990, the entire teachings of which are hereby incorporated by reference. The conversion comprises the following steps: 1) time windowing followed by the Fourier transform; 2) calculating power spectrum; 3) filtering the power spectrum by a filter bank specified on the Bark frequency scale and accommodating the known psychoacoustic masking phenomena; 4) raising the components of the filter-bank output to the order of 0.3. The resulting PLS is a vector (e.g., of order 23 for 22 kHz speech) whose components are proportional to perceptual loudness levels associated with respective critical frequency bands.

Let $V(t)=[v_1(t), \ldots, v_N(t)]$ be the PLS vector derived from the t-th frame where N is the number of frequency bands; and T be the number of frames in the segment.

Let $M1_k$ and $M2_k$ be respectively empirical first and second moments of the k-th component of the PLS vector distribution within the segment:

$$M1_k = \frac{1}{T}\sum_{t=1}^{T} v_k(t) \quad M2_k = \frac{1}{T}\sum_{t=1}^{T} v_k^2(t) \tag{1}$$

In accordance with an embodiment of the invention, the segment non-stationarity measure R can be defined as integral relative variance of the PLS vector components:

$$R = \frac{\sum_{k=1}^{N}(M2_k - M1_k^2)}{\sum_{k=1}^{N} M2_k} \tag{2}$$

In accordance with an embodiment of the invention, the temporal stationarity score of the segment is defined as:

$$S = \frac{1 - R - 1/T}{1/T} \tag{3}$$

which yields $$S = \frac{\sum_{k=1}^{N} M1_k^2 \Big/ \sum_{k=1}^{N} M2_k - 1/T}{1 - 1/T} \tag{4}$$

The stationarity score of Equation (4) has the range [0,1]. It receives the value of 1 for an ideally stationary segment with invariant Perceptual Loudness Spectrum. The score receives the value 0 for an extremely non-stationary (singular) segment that has δ-like temporal loudness distribution, e.g., only one non-silent frame. To give an intuitive insight of the matter, a stationary segment has: a) a slowly evolving spectral envelope; and b) an excitation represented by a mix of quasi periodic and random stationary components. Typically, a segment representing a stable part of a vowel or a fricative sound has a high stationarity score. Transient sounds and plosive onsets have a low stationarity score. Other techniques of determining stationarity than that given in Equation (4) may be used.

Figure 2:
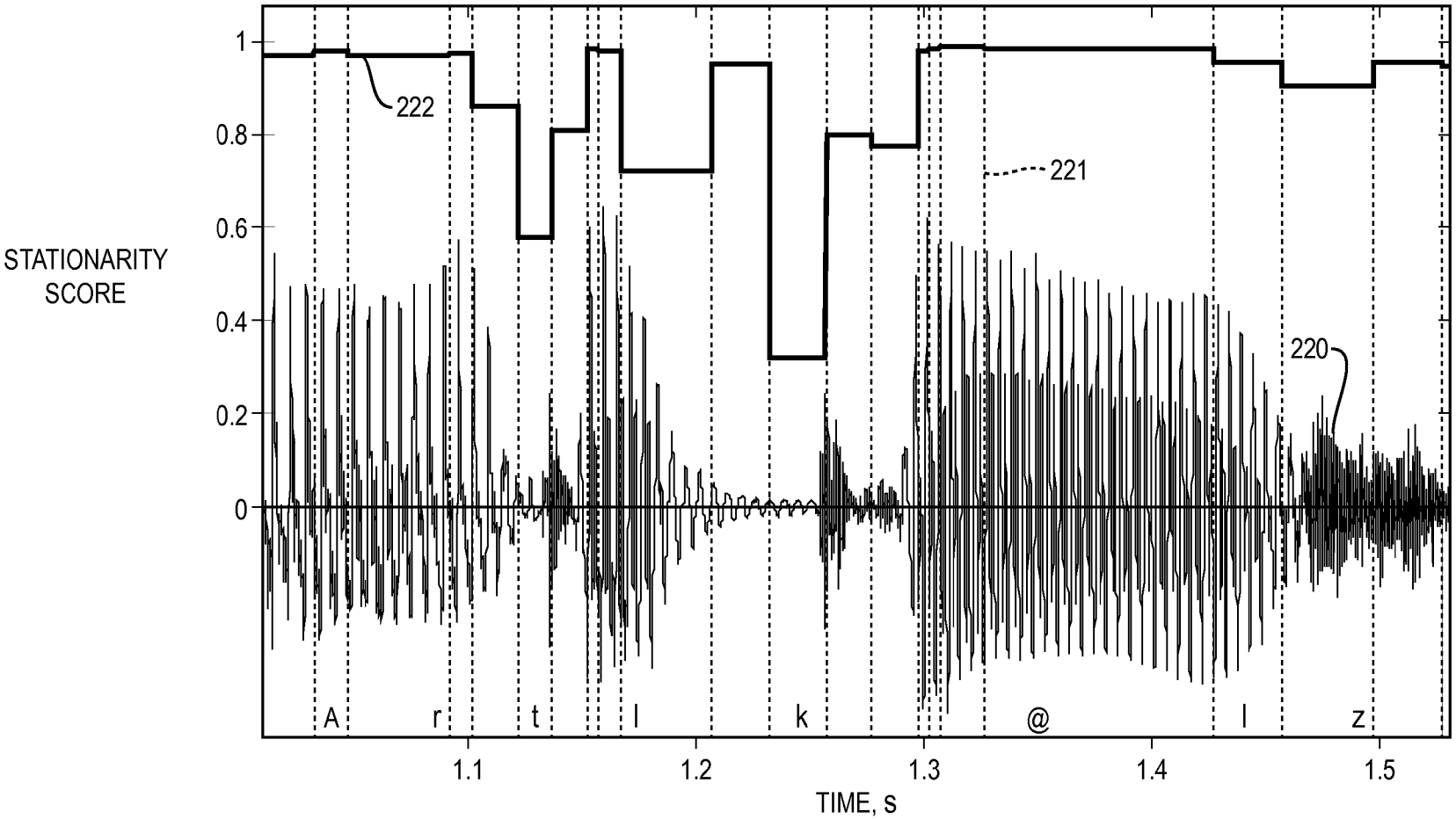
FIG. 2 is a diagram showing segmental stationarity scores, determined in accordance with an embodiment of the invention.

FIG. 2 is a diagram showing segmental stationarity scores, determined in accordance with an embodiment of the invention. In the example shown in FIG. 2, the stationarity scores are determined for consecutive segments extracted from the same speech signal. The speech waveform is shown by line 220, segment boundaries are shown by lines 221 and the stationarity score values are represented by lines 222. The uttered text is also displayed on the diagram aligned with the waveform.

Method for Selection of Segment Representation in Multi-Form Speech Synthesis

In accordance with embodiments of the invention, such segment stationarity scores may be used for determining a selection of segment representation type (template versus model) in multi-form speech synthesis. Specifically, the more stationary the segment is the more favorable it is for being replaced by a model-based representation. Applicants have found that the representation type selection based on a combination of the stationarity and loudness performs better than the one based on the stationarity only. Without being bound by theory, this can be explained by the fact that the most stationary segments typically represent the louder parts of vowels. Hence the template-model joints and the modeled character of voice can become audible. To include this sensitivity into the modelability score, the stationarity score may be augmented with a loudness score as defined above.

In embodiments according to the invention, the temporal stationarity score is determined for each segment available in the templates database. Additionally, a loudness score may be determined for each segment as:

$$L = \frac{1}{T}\sum_{t=1}^{T}\sum_{k=1}^{N} v_k(t) = \sum_{k=1}^{N} M1_k \tag{5}$$

In accordance with a first, "dynamic," embodiment of the method, the stationarity scores and loudness scores are normalized over the voice dataset as described below. Let $S_j$ and $L_j$ be respectively the stationarity and loudness scores of segment j and J be the number of segments in the templates database. The normalized scores $NS_j$ and $NL_j$ are calculated as:

$$NS_j = \frac{S_j - \min_{1\le j\le J} S_j}{\max_{1\le j\le J} S_j - \min_{1\le j\le J} S_j} \quad NL_j = \frac{L_j - \min_{1\le i\le J} L_j}{\max_{1\le j\le J} L_j - \min_{1\le j\le J} L_j} \tag{6}$$

Further, in accordance with the first embodiment of the method, the segmental modelability score (SMOD) may be defined as:

$$SMOD_j = 0.5\cdot(NS_j + 1 - NL) \tag{7}$$

Such a segmental modelability score, defined within the range [0,1], receives a higher value as the segment is more stationary and less loud. Other techniques of determining such a segmental modelability score may be used; for instance, a non-linear combination of $NS_j$ and $NL_j$ may be used.

In accordance with the first embodiment of the method, the segmental modelability scores are stored and used in synthesis time for segment representation type selection in an MFS synthesis system. For example, as an addition to be used within the context of the framework described in V. Pollet, A. Breen, "Synthesis by generation and concatenation of multiform segments", in Proc *Interspeech* 2008 (the entire teachings of which are hereby incorporated herein by reference), the segmental modelability scores determined in accordance with an embodiment of the present invention can serve as the channel cues employed in a combination with phonologic cues for segment representation type selection. As another example, as an addition to be used within the framework described in U.S. Patent Application Publication No. US 2009/0048841 A1 of Pollet et al. (the entire teachings of which are hereby incorporated herein by reference), the segmental modelability scores determined in accordance with an embodiment of the present invention can be used to augment the information used by the model-template sequencer. As another example, as an addition to be used in the system described in S. Tiomkin et al., "A hybrid text-to-speech system that combines concatenative and statistical synthesis units," IEEE Trans on Audio, Speech and Language Processing, v 19, no 5, July 2011 (the entire teachings of which are hereby incorporated herein by reference), the segmental modelability scores determined in accordance with an embodiment of the present invention may be incorporated in the natural mode versus statistical mode decision.

Figure 3:
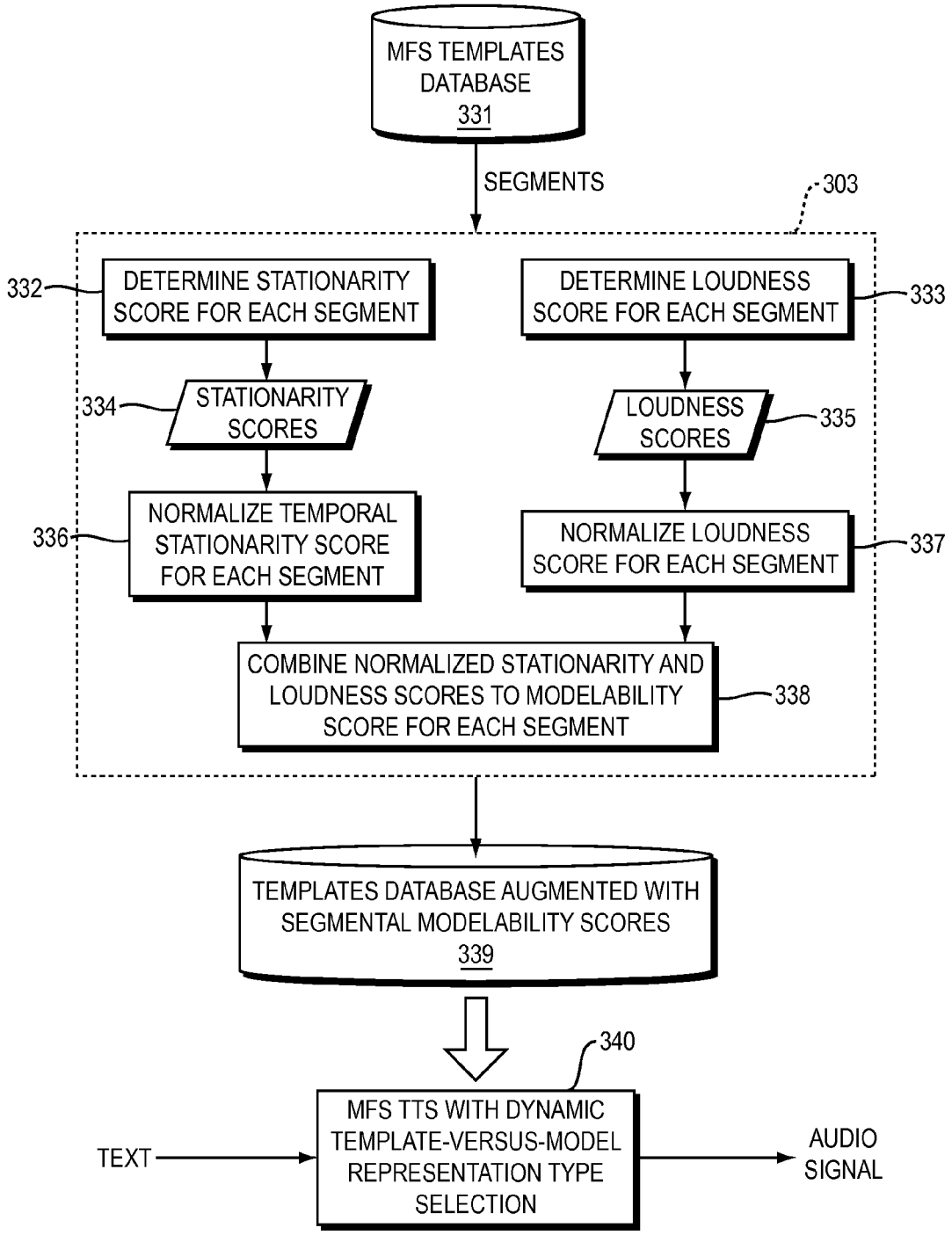
FIG. 3 is a block diagram of a system for dynamic selection of segment representation type in multi-form speech synthesis, in accordance with an embodiment of the invention.

FIG. 3 is a block diagram of a system for determining segmental modelability scores used for dynamic selection of segment representation type in multi-form speech synthesis, in accordance with the first embodiment above of the method. A modelability estimator 303 is configured to determine a segmental modelability score (for example a score SMOD of equation (7)) for each segment from the template database 331. The modelability estimator 303 determines 332 a stationarity score 334 (for example score S of equation (4)) and determines 333 a loudness score 335 (for example score L of equation (5)) for each segment. Further, the modelability estimator 303 normalizes stationarity scores 336 and loudness score 337, for example in accordance with equation (6). Finally, the modelability estimator 303 combines 338 the normalized stationarity and loudness scores for each segment, for example in accordance with equation (7). The segmental modelability scores are then used in an MFS TTS system for dynamic selection of segment representation type in synthesis time as described above. For example, a templates database 339 augmented with segmental modelability scores may be used by an MFS TTS system 340 for dynamic template versus model representation type selection.

In accordance with a second, "static," embodiment of the method, for each acoustic leaf cluster, the empirical distribution of the segmental stationarity score and segmental loudness score may be analyzed. A leaf stationarity measure (LSM) and leaf loudness measure (LLM) may be derived as certain percentiles of the respective empirical distribution within the leaf cluster. Typically the LSM and LLM are set close respectively to the lower and upper bound of the respective segmental score distribution within the leaf cluster. For example: the leaf is assigned LSM=S if 90% of the segments comprising it have the stationarity score values above S; and the leaf is assigned LLM=L if 90% of the segments comprising it have the loudness score values below L.

Figure 4:
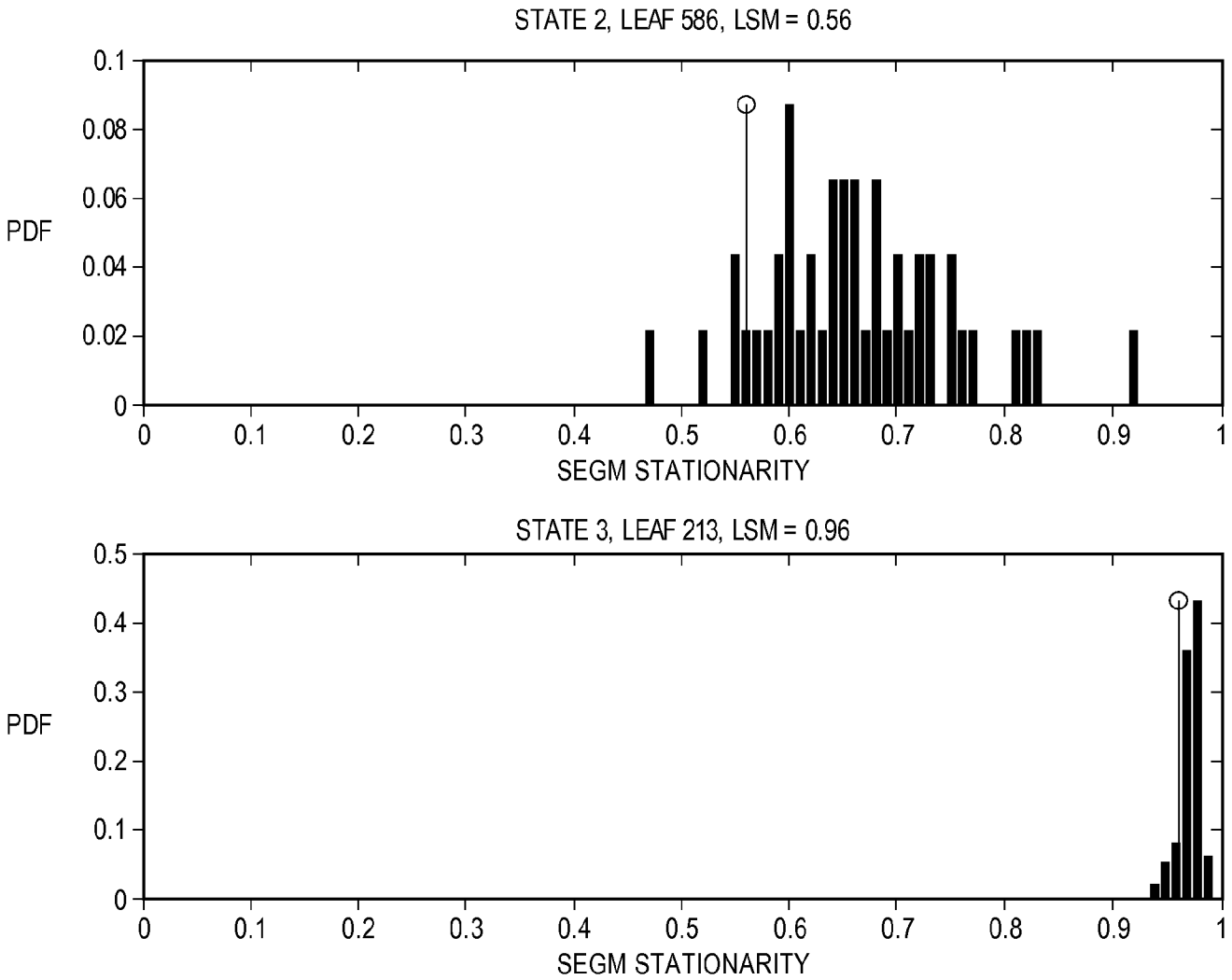
FIG. 4 depicts histograms of segmental stationarity scores and a Leaf Stationarity Measure determined for two acoustic leaves in accordance with an embodiment of the invention.

FIG. 4 depicts histograms of segmental stationarity scores and a Leaf Stationarity Measure determined for two acoustic leaves in accordance with an embodiment of the invention. In the examples shown in FIG. 4, the stationarity score histogram is depicted by the bar diagram and the LSM position is marked by the stem. The upper diagram shows the leaf representing the beginning of the phone "p" with LSM=0.56, and the lower diagram shows the leaf associated with the middle part of the phone "E," with LSM=0.96. It will be appreciated that other percentiles and other techniques of determining stationarity measures and loudness measures for each leaf may be used.

In accordance with an embodiment of the invention, the leaf stationarity and loudness measures defined above may be normalized over the voice as follows. Let $LS_i$ and $LL_i$ be the LSM and LLM of the leaf i respectively, and I be the number of the acoustic leaves in the system. The normalized values $NLS_i$ and $NLL_i$ are calculated as:

$$NLS_i = \frac{LS_i - \min_{1\le j\le I} LS_i}{\max_{1\le j\le I} LS_i - \min_{1\le j\le I} LS_i} \quad NLL_i = \frac{LL_i - \min_{1\le i\le I} LL_i}{\max_{1\le j\le I} LL_i - \min_{1\le j\le I} LL_i} \tag{8}$$

Further, in accordance with an embodiment of the invention, the leaf modelability score (LMOD) may be defined as:

$$LMOD_i = 0.5\cdot(NLS_i + 1 - NLL_i) \tag{9}$$

Such a leaf modelability score is defined within the range [0,1]. Other techniques of determining such a leaf modelability score may be used; for instance, a non-linear combination of $NLS_i$ and $NLL_i$ may be used.

In accordance with an embodiment of the invention, all of the acoustic leaves may be ordered by their modelability score values. A target footprint reduction percentage P % is achieved by marking the required number of the most modelable acoustic leaves and removing all the template segments that are associated with them from the templates database. The number of the leaves to be marked is calculated such that the durations of the template segments associated with those leaves are summed up to approximately P % of the total duration of all of the template segments in the original templates database. The reduced voice dataset is used for the synthesis. At synthesis time, segments associated with the marked (free of templates) leaves are generated from the respective statistical parametric models while other leaves are represented by templates.

Figure 5:
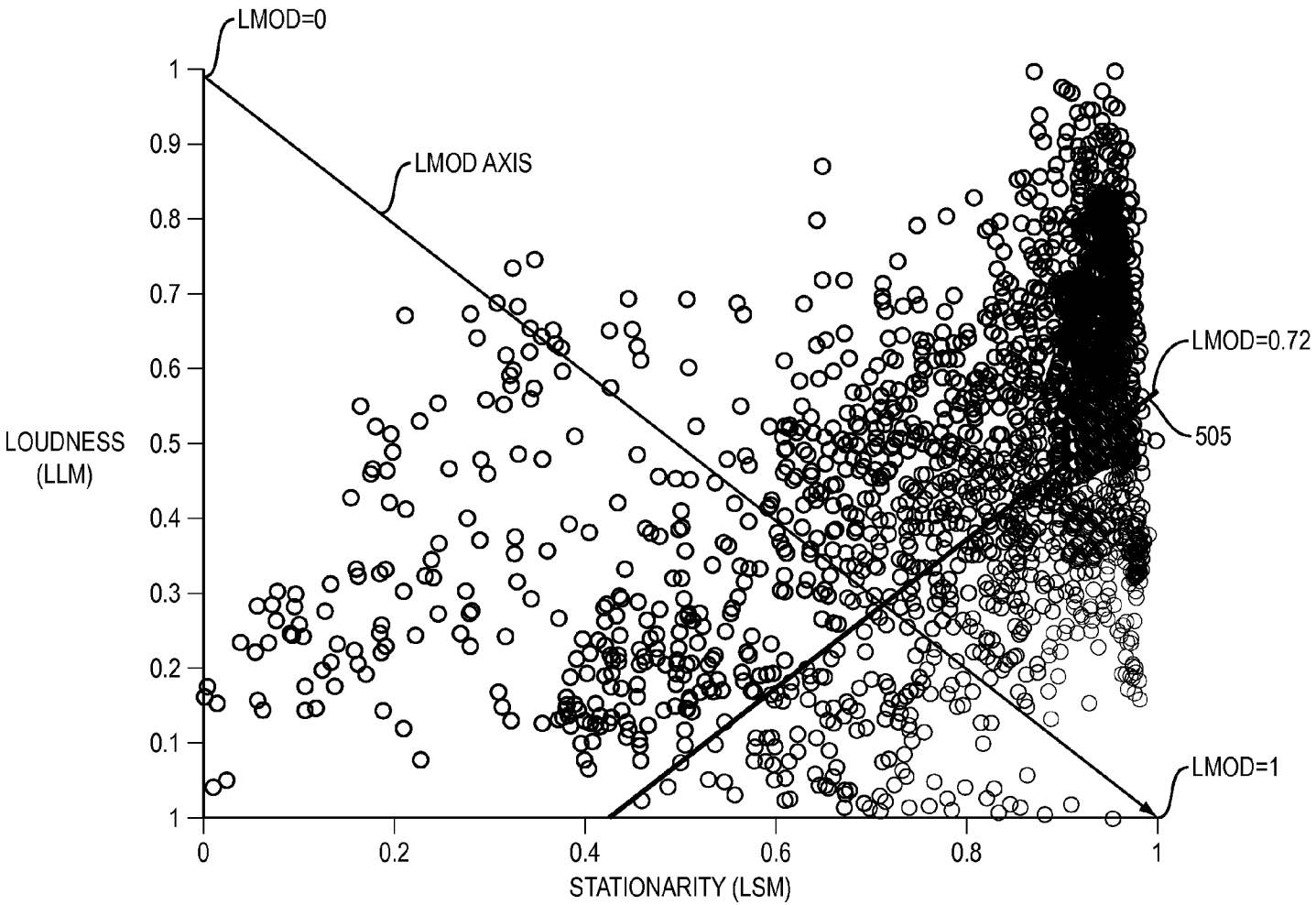
FIG. 5 is a graph illustrating leaf modelability mapping and the model-template leaf dichotomy, in accordance with an embodiment of the invention.

FIG. 5 is a graph illustrating leaf modelability mapping and the model-template leaf dichotomy, in accordance with an embodiment of the invention. This example shows leaf modeling suitability scoring for a female U.S. English voice. All of the acoustic leaves of the voice dataset are depicted by the dots (the circle centers) at the NLS-NLL plane. The modelability score value of a leaf can be obtained by the projection of the corresponding dot to the LMOD axis. For the footprint reduction P=30% chosen as an example, the line LMOD=0.72 (marked 505) separates between the model leaves (located below the line) and the template leaves (located above the line).

In accordance with an embodiment of the invention, generation of model segments is carried out in a way that reduces discontinuities at template-model joints using known in the art techniques, for example the boundary constrained model generation described in S. Tiomkin et al., "A hybrid text-to-speech system that combines concatenative and statistical synthesis units", IEEE Trans on Audio, Speech and Language Processing, v 19, no 5, July 2011, the entire teachings of which are hereby incorporated herein by reference.

The method disclosed above, in accordance with an embodiment of the invention, produces high quality speech within a wide range of footprints.

In accordance with an embodiment of the invention, the segment or leaf representation type decision may also be based on other contributing factors, such as phonologic cues. The final decision may be based on both phonologic and signal-based cues. Alternatively, it is also possible to use only the modelability scores described above as the basis for the segment or leaf representation type decision. This may be useful where, for example, there is little or no phonologic knowledge available (for example, with a new language).

Figure 6:
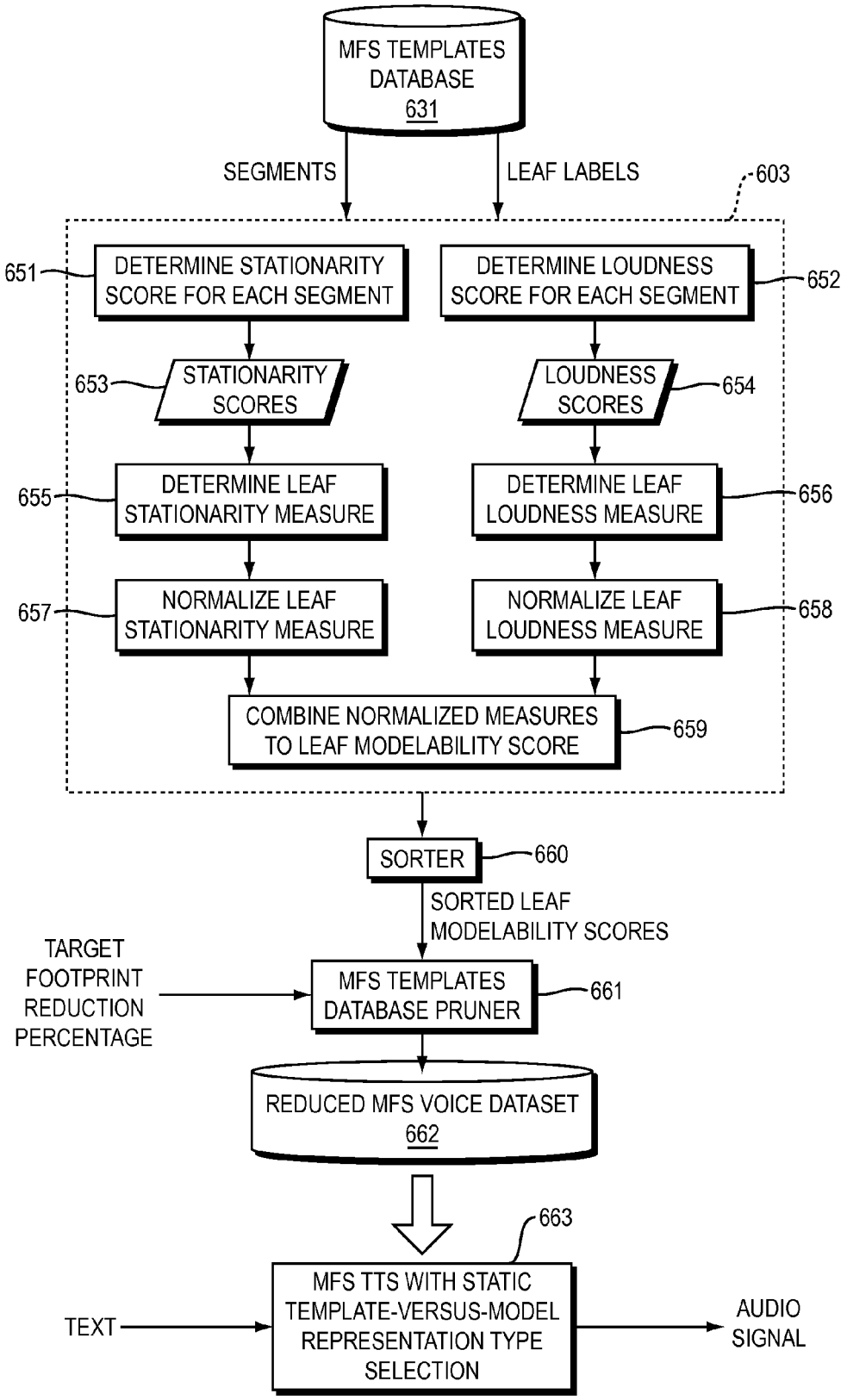
FIG. 6 is a block diagram of a system for static selection of segment representation type in multi-form speech synthesis, in accordance with an embodiment of the invention.

FIG. 6 is a block diagram of a system for determining a selection of segment representation type in multi-form speech synthesis, in accordance with the second, "static," embodiment above of the method. Segments from the templates database 631 labeled by acoustic leaf identifiers are input to a modelability estimator 603 which is configured to score modelability of acoustic leaves. The modelability estimator 603 determines 651 segmental stationarity score 653 (for example score S of equation (4)) and determines 652 segmental loudness score 654 (for example score L of equation (5)) for each segment. Further the modelability estimator 603 aggregates the segmental stationarity scores associated with a leaf and determines 655 a leaf stationarity measure as a statistic of the segmental stationarity score distribution within the leaf cluster (for example a percentile as described above). Analogously, the modelability estimator aggregates the segmental loudness scores associated with a leaf and determines 656 a leaf loudness measure as a statistic of the segmental loudness score distribution within the leaf cluster (for example a percentile as described above). Further the modelability estimator normalizes 657 the leaf stationarity measures and normalizes 658 the leaf loudness measures, calculating normalized leaf stationarity measures and normalized leaf loudness measures (for example NLS and NLL of equation (8)). Finally the modelability estimator combines 659 normalized leaf stationarity measure and normalized leaf loudness measure to determine a leaf modelability score for each leaf (for example following equation (9)). The leaf modelability scores output from the modelability estimator are fed to a sorter 660 which sorts them in ascending or descending order. A pruner 661 removes a number of the most modelable leaves based on the sorted leaf modelability scores and target footprint reduction percentage as described above. The resulting reduced MFS voice dataset 662 is used in an MFS system 663 which determines a segment type representation based on presence or absence of templates associated with an acoustic leaf as described above.

It will be appreciated that a combination of the first (dynamic) and second (static) embodiments described above of the method can be devised. In such a combined embodiment the modelability estimator is configured to provide both segmental and leaf modelability scores. The MFS voice dataset is pruned by removing entire leaf clusters and individual segments based on the leaf modelability scores and segmental modelability scores respectively. In synthesis time, the segments associated with the "empty" leaves are generated from statistical models while a dynamic selection of representation type is applied to the other segments.

Method for Preferred Speaker Selection for Statistical TTS System Build

In accordance with another embodiment of the invention, the segment stationarity scores described above may be used for determining a preferred speaker selection for a statistical TTS system build. A relatively small number (e.g., 50) of sentences read out by each candidate speaker is recorded. The following process is applied to the recording set associated with each candidate speaker. An HMM-state level alignment and segmentation is applied to each speech signal using a pre-existing acoustic model. The temporal stationarity score of Equation (4) is calculated for each segment. The empirical distribution of the segmental stationarity scores is analyzed and a speaker voice modelability score is derived, e.g., as the empirical mean or median value. The modelability scores associated with the speakers are compared to each other and the speaker having the highest one is selected.

Figure 7:
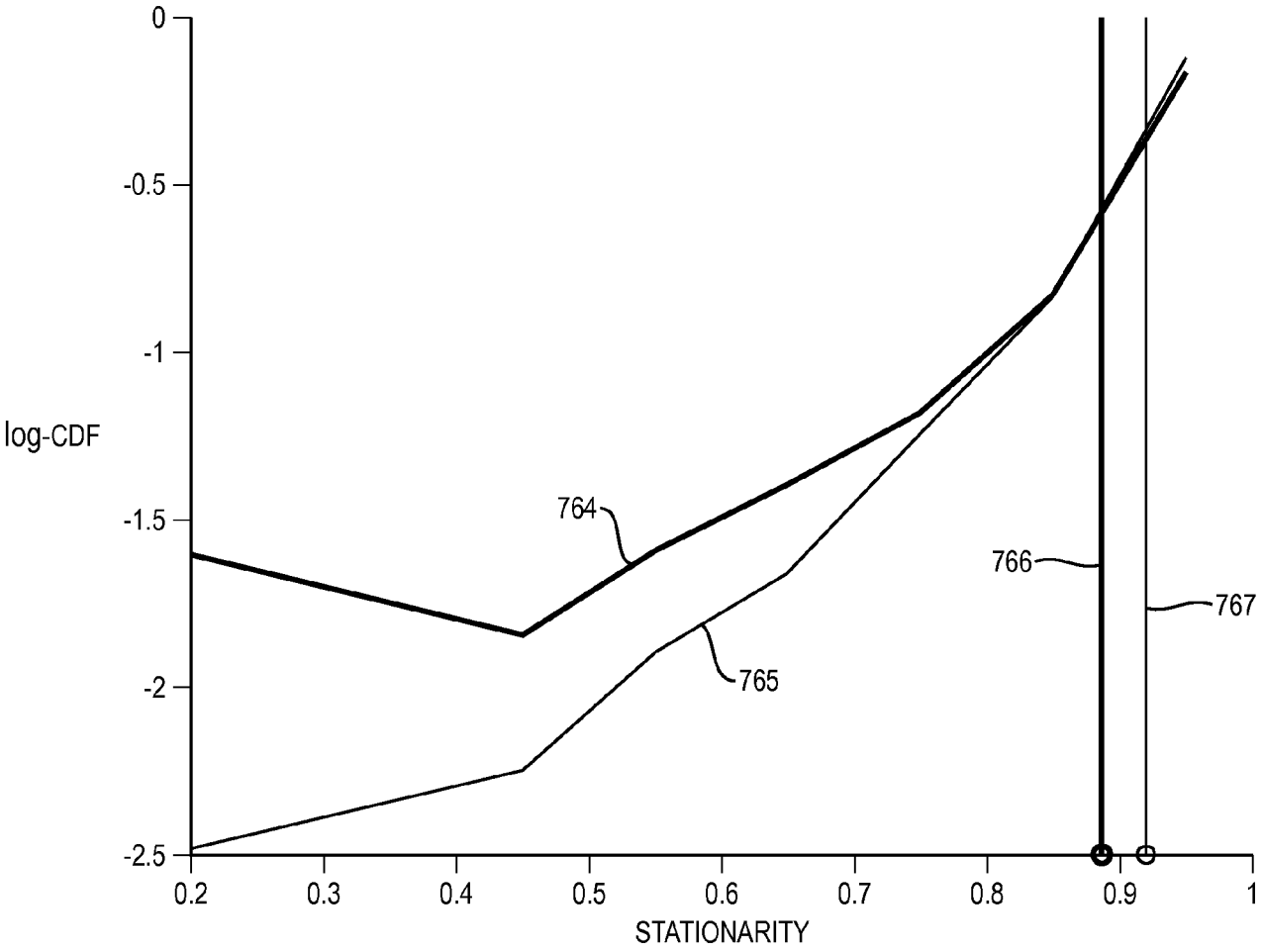
FIG. 7 is a graph depicting an example of a comparison of two speakers based on voice stationarity, in accordance with an embodiment of the invention.

FIG. 7 depicts an example of a comparison of two speakers based on voice stationarity, in accordance with an embodiment of the invention. The logarithm of the empirical cumulative distribution functions of the segmental stationarity score for speaker 1 and speaker 2 are represented by curves 764 and 765 respectively. The corresponding empirical mean values are depicted as vertical lines 766 and 767 (respectively). It is observed that the voice of speaker 2 is more stationary statistically than the voice of speaker 1. The comparison is based on 100 sentences. (In a subjective listening evaluation a statistical TTS system trained on speaker 2 voice outperformed a similar system trained on speaker 1 voice.)

Figure 8:
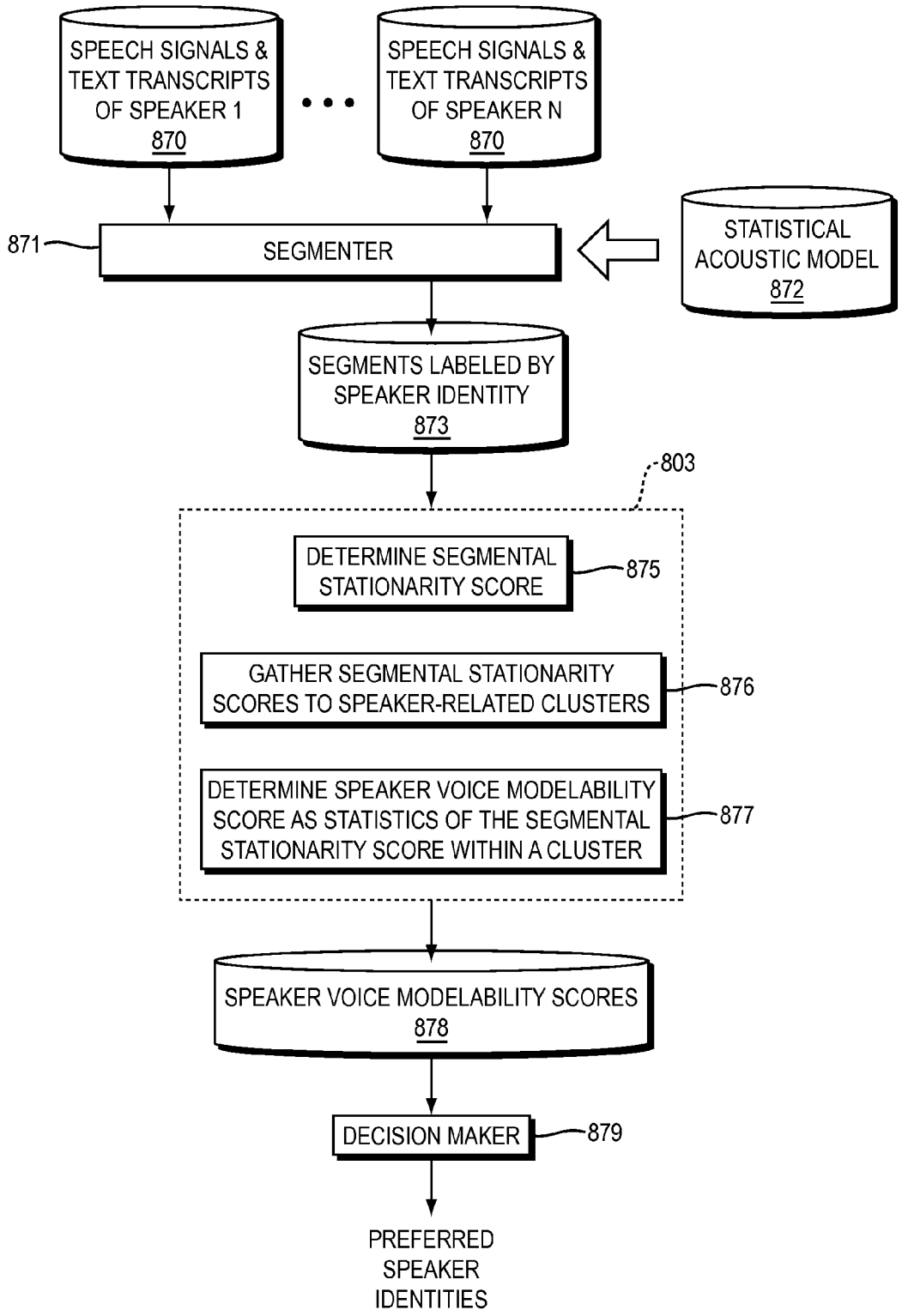
FIG. 8 is a block diagram of a system for determining a preferred speaker selection for a statistical TTS system build, in accordance with an embodiment of the invention.

FIG. 8 is a block diagram of a system for determining a preferred speaker selection for a statistical TTS system build, in accordance with an embodiment of the invention. The input 870 for the system comprises speech signals provided by two or more speakers accompanied with respective text transcripts. A segmenter 871 decomposes the signals to phonetically motivated segments applying one of the known in the art alignment techniques using a preexisting acoustic model 872. The segments 873 labeled by respective speaker identity are input to a speaker voice modelability estimator 803. The modelability estimator is configured to determine 875 a stationarity score for each segment (for example score S of equation (4)). The modelability estimator 803 is further configured to gather 876 the segmental stationarity scores to speaker-related clusters. The modelability estimator 803 is further configured to determine 877 for each speaker-related cluster a speaker voice modelability score based on the stationarity score distribution with the cluster, for example as empirical mean value. Speaker voice modelability scores 878 output from the modelability estimator are further processed by a decision maker 879 which selects one or more speaker identities corresponding to the highest modelability score values.

An embodiment according to the invention may be used in other contexts in which it is advantageous to automatically determine suitability of a speech signal for statistical modeling.

Figure 9:
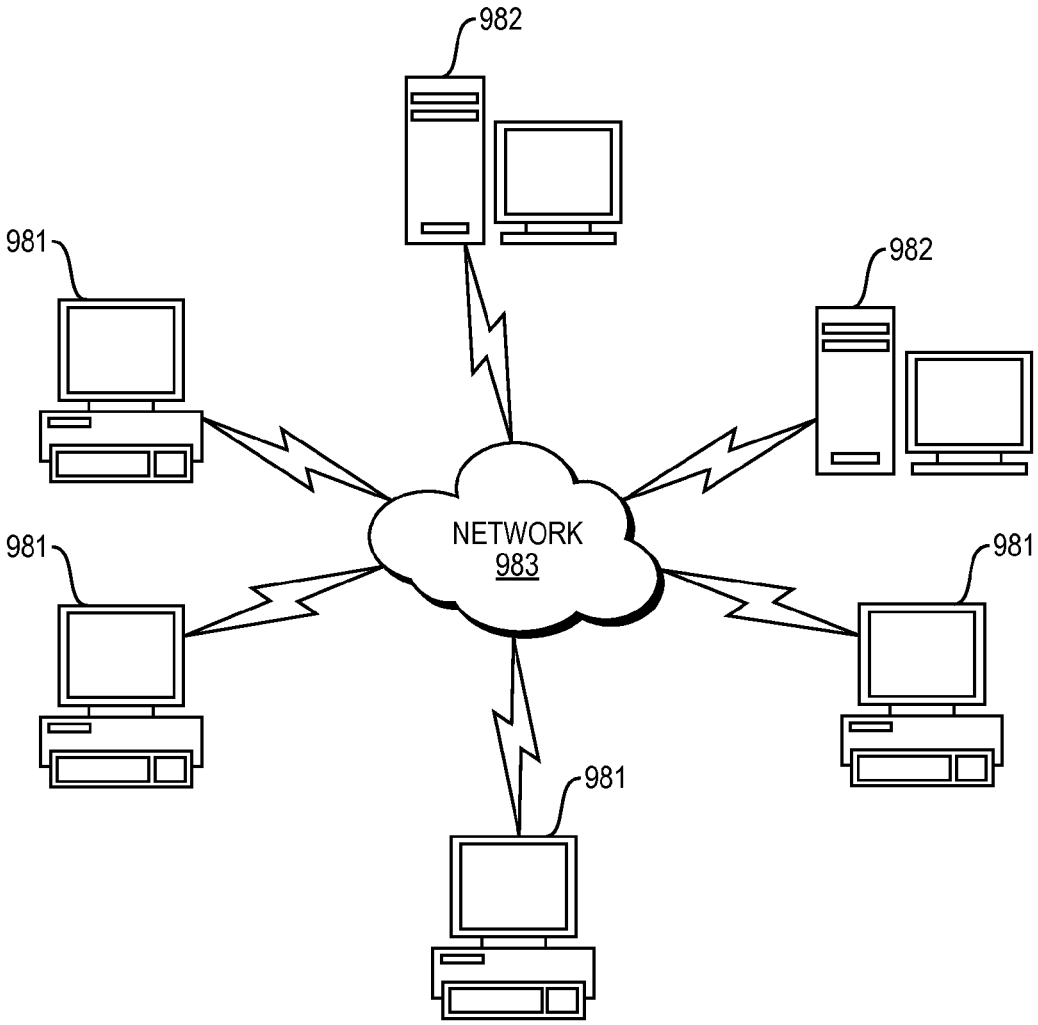
FIG. 9 illustrates an example computer network or similar digital processing environment in which the present invention may be implemented.

FIG. 9 illustrates a computer network or similar digital processing environment in which the present invention may be implemented. Client computer(s)/devices 981 and server computer(s) 982 provide processing, storage, and input/output devices executing application programs and the like. Client computers 981 can include, for example, the computers of users receiving a determination of suitability of at least a portion of a speech signal for statistical modeling, in accordance with an embodiment of the invention; and server computers 982 can include the systems of FIGS. 1, 3, 6 and/or 8 and/or other systems implementing a technique for determining suitability of at least a portion of a speech signal for statistical modeling, in accordance with an embodiment of the invention. Client computer(s)/devices 981 can also be linked through communications network 983 to other computing devices, including other client devices/processes 981 and server computer(s) 982. Communications network 983 can be part of a remote access network, a global network (e.g., the Internet), a worldwide collection of computers, Local area or Wide area networks, and gateways that currently use respective protocols (TCP/IP, Bluetooth, etc.) to communicate with one another. Other electronic device/computer network architectures are suitable.

Figure 10:
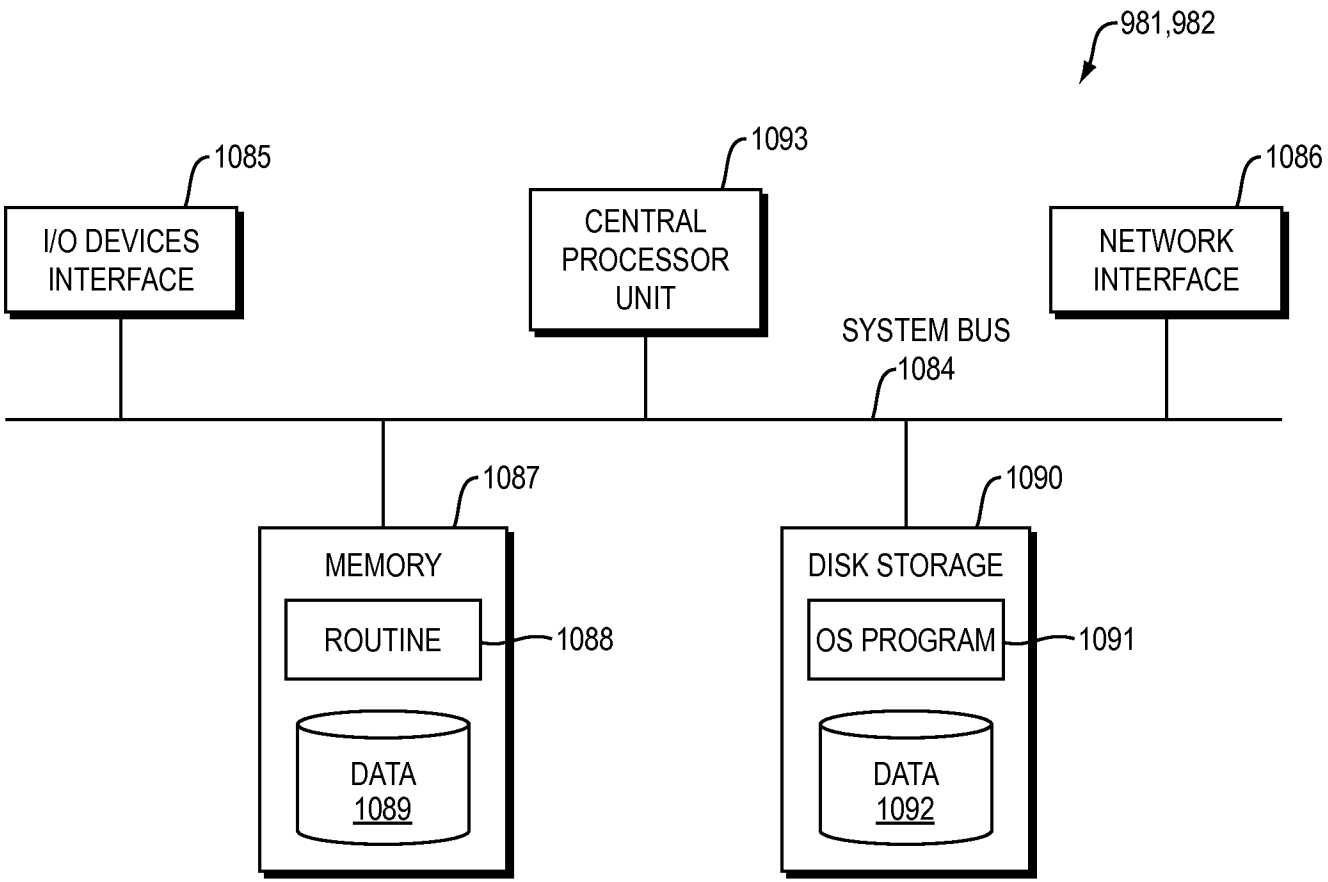
FIG. 10 is a diagram of an example internal structure of a computer in the computer system of FIG. 9, in accordance with an embodiment of the invention.

FIG. 10 is a diagram of the internal structure of a computer (e.g., client processor/device 981 or server computers 982) in the computer system of FIG. 9, in accordance with an embodiment of the invention. Each computer 981, 982 contains system bus 1084, where a bus is a set of hardware lines used for data transfer among the components of a computer or processing system. Bus 1084 is essentially a shared conduit that connects different elements of a computer system (e.g., processor, disk storage, memory, input/output ports, network ports, etc.) that enables the transfer of information between the elements. Attached to system bus 1084 is I/O device interface 1085 for connecting various input and output devices (e.g., keyboard, mouse, displays, printers, speakers, etc.) to the computer 981, 982. Network interface 1086 allows the computer to connect to various other devices attached to a network (e.g., network 983 of FIG. 9). Memory 1087 provides volatile storage for computer software instructions 1088 and data 1089 used to implement an embodiment of the present invention (e.g., routines for determining suitability of at least a portion of a speech signal for statistical modeling). Disk storage 1090 provides non-volatile storage for computer software instructions 1091 and data 1092 used to implement an embodiment of the present invention. Central processor unit 1093 is also attached to system bus 1084 and provides for the execution of computer instructions.

A system in accordance with the invention has been described in which there is determined the suitability of at least portion of a speech signal for statistical modeling. Components of such a system, for example a modelability estimator, decision maker, templates pruner and other systems discussed herein may, for example, be a portion of program code, operating on a computer processor.

Portions of the above-described embodiments of the present invention can be implemented using one or more computer systems, for example to permit determine suitability of at least a portion of a speech signal for statistical modeling. For example, the embodiments may be implemented using hardware, software or a combination thereof. When implemented in software, the software code can be stored on any form of non-transient computer-readable medium and loaded and executed on any suitable processor or collection of processors, whether provided in a single computer or distributed among multiple computers.

Further, it should be appreciated that a computer may be embodied in any of a number of forms, such as a rack-mounted computer, a desktop computer, a laptop computer, or a tablet computer. Additionally, a computer may be embedded in a device not generally regarded as a computer but with suitable processing capabilities, including a Personal Digital Assistant (PDA), a smart phone or any other suitable portable or fixed electronic device.

Also, a computer may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

Also, the various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, at least a portion of the invention may be embodied as a computer readable medium (or multiple computer readable media) (e.g., a computer memory, one or more floppy discs, compact discs, optical discs, magnetic tapes, flash memories, circuit configurations in Field Programmable Gate Arrays or other semiconductor devices, or other tangible computer storage medium) encoded with one or more programs that, when executed on one or more computers or other processors, perform methods that implement the various embodiments of the invention discussed above. The computer readable medium or media can be transportable, such that the program or programs stored thereon can be loaded onto one or more different computers or other processors to implement various aspects of the present invention as discussed above.

In this respect, it should be appreciated that one implementation of the above-described embodiments comprises at least one computer-readable medium encoded with a computer program (e.g., a plurality of instructions), which, when executed on a processor, performs some or all of the above-discussed functions of these embodiments. As used herein, the term "computer-readable medium" encompasses only a non-transient computer-readable medium that can be considered to be a machine or a manufacture (i.e., article of manufacture). A computer-readable medium may be, for example, a tangible medium on which computer-readable information may be encoded or stored, a storage medium on which computer-readable information may be encoded or stored, and/or a non-transitory medium on which computer-readable information may be encoded or stored. Other non-exhaustive examples of computer-readable media include a computer memory (e.g., a ROM, a RAM, a flash memory, or other type of computer memory), a magnetic disc or tape, an optical disc, and/or other types of computer-readable media that can be considered to be a machine or a manufacture.

The terms "program" or "software" are used herein in a generic sense to refer to any type of computer code or set of computer-executable instructions that can be employed to program a computer or other processor to implement various aspects of the present invention as discussed above. Additionally, it should be appreciated that according to one aspect of this embodiment, one or more computer programs that when executed perform methods of the present invention need not reside on a single computer or processor, but may be distributed in a modular fashion amongst a number of different computers or processors to implement various aspects of the present invention.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

The teachings of all patents, published applications and references cited herein are incorporated by reference in their entirety.

While this invention has been particularly shown and described with references to example embodiments thereof, it will be understood by those skilled in the art that various changes in form and details may be made therein without departing from the scope of the invention encompassed by the appended claims.

What is claimed is:

1. A computer server system for automatically determining suitability of at least a portion of a speech signal, comprising voice data, for statistical modeling, the system comprising:

a memory storing computer code instructions thereon; and a processor, the memory, with the computer code instructions, and the processor being configured to cause the computer server system to implement:

a modelability estimator configured to:

determine a statistical modelability score of the at least a portion of the speech signal comprising voice data, the statistical modelability score indicating favorability of the at least a portion of the speech signal for statistical modeling in terms of human perception and based at least in part on determining a temporal stationarity of the at least a portion of the speech signal comprising voice data; and forward the statistical modelability score to a speech synthesis system executed by the processor, wherein the speech synthesis system is configured to utilize the modelability score in converting text to speech; and a decision maker configured to determine a preferred speaker selection for use by the speech synthesis system in building a statistical text-to-speech system based on the statistical modelability score determined for speech provided by each of a plurality of speakers.

2. The computer server system according to claim 1, wherein the modelability estimator is further configured to determine the temporal stationarity based on variability of an instantaneous spectrum of the at least a portion of the speech signal.

3. The computer server system according to claim 2, wherein the modelability estimator is still further configured to determine the variability of the instantaneous spectrum based on (i) a first moment of an instantaneous spectrum component distribution and (ii) a second moment of the instantaneous spectrum component distribution.

4. The computer server system according to claim 1, wherein the decision maker is further configured to:

determine a segment representation type to be used by the speech synthesis system in a multi-form segment speech synthesis based on the statistical modelability score.

5. The computer server system according to claim 4, wherein the modelability estimator is further configured to determine the statistical modelability score for at least one segment comprising at least a portion of an output speech signal being synthesized, and wherein the decision maker is further configured to determine the segment representation type, for the at least one segment, based on at least the statistical modelability score for the at least one segment.

6. The computer server system according to claim 4, wherein the modelability estimator is further configured to determine for at least one segment comprising at least a portion of an output speech signal being synthesized, the statistical modelability score for a segment cluster that includes the at least one segment, and wherein the decision maker is further configured to determine the segment representation type, for the at least one segment, based on at least the statistical modelability score of the segment cluster that includes the at least one segment.

7. The computer server system according to claim 4, further comprising a templates pruner configured to remove from a voice dataset at least one segment relative to its statistical modelability score.

8. The computer server system according to claim 4, wherein the statistical modelability score is further based at least in part on a loudness score.

9. A computerized method of automatically determining, by a server, suitability of at least a portion of a speech signal, comprising voice data, for statistical modeling, the computerized method comprising:

determining a statistical modelability score of the at least a portion of the speech signal comprising voice data, the statistical modelability score indicating favorability of the at least a portion of the speech signal for statistical modeling in terms of human perception and based at least in part on a temporal stationarity of the at least a portion of the speech signal comprising voice data;

forwarding the statistical modelability score to a speech synthesis system implemented by the server, wherein the speech synthesis system is configured to utilize the modelability score in converting text to speech; and determining a preferred speaker selection for use by the speech synthesis system in building a statistical text-to-speech system based on the statistical modelability score determined for speech provided by each of a plurality of speakers.

10. The computerized method according to claim 9, wherein the temporal stationarity is determined based on variability of an instantaneous spectrum of the at least a portion of the speech signal.

11. The computerized method according to claim 10, wherein the variability of the instantaneous spectrum is determined based on (i) a first moment of an instantaneous spectrum component distribution and (ii) a second moment of the instantaneous spectrum component distribution.

12. The computerized method according to claim 9, wherein the method comprises determining a segment representation type to be used by the speech synthesis system in a multi-form segment speech synthesis system based on the statistical modelability score.

13. The computerized method according to claim 12, further comprising:

determining the statistical modelability score for at least one segment comprising at least a portion of an output speech signal being synthesized; and determining the segment representation type, for the at least one segment, based on at least the statistical modelability score for the at least one segment.

14. The computerized method according to claim 12, further comprising:

determining, for at least one segment comprising at least a portion of an output speech signal being synthesized, the statistical modelability score for a segment cluster that includes the at least one segment; and determining the segment representation type, for the at least one segment based on at least the statistical modelability score of the segment cluster that includes the at least one segment.

15. The computerized method according to claim 14, further comprising removing from a voice dataset at least one segment relative to its statistical modelability score.

16. The computerized method according to claim 12, further comprising determining the statistical modelability score based at least in part on a loudness score.

17. A non-transitory computer-readable storage medium having computer-readable code stored thereon, which, when executed by a computer processor, causes the computer processor to automatically determine suitability of at least a portion of a speech signal, comprising voice data, for statistical modeling, by causing the processor to:

determine a statistical modelability score of the at least a portion of the speech signal comprising voice data, the statistical modelability score indicating favorability of the at least a portion of the speech signal for statistical modeling in terms of human perception and the statistical modelability score being based at least in part on a temporal stationarity of the at least a portion of the speech signal comprising voice data;

forward the statistical modelability score to a speech synthesis system executed by the processor, wherein the speech synthesis system is configured to utilize the modelability score in converting text to speech; and determine a preferred speaker selection for use by the speech synthesis system in building a statistical text-to-speech system based on the statistical modelability score determined for speech provided by each of a plurality of speakers.

* * * * *